US006416063B1

(12) United States Patent
Stillinger et al.

(10) Patent No.: US 6,416,063 B1
(45) Date of Patent: Jul. 9, 2002

(54) HIGH PERFORMANCE SKATE

(76) Inventors: Scott H. Stillinger; Daniel M. Humes, both of 15360 Robin Ann La., Monte Sereno, CA (US) 95030

( * ) Notice: Subject to any disclaimer, the term of this patent is extended or adjusted under 35 U.S.C. 154(b) by 0 days.

(21) Appl. No.: 09/352,460

(22) Filed: Jul. 13, 1999

Related U.S. Application Data

(63) Continuation-in-part of application No. 09/014,697, filed on Jan. 28, 1998, now abandoned.

(51) Int. Cl.[7] ..... A63C 17/06

(52) U.S. Cl. ..... 280/11.223; 280/11.225; 280/11.28

(58) Field of Search ..... 280/11.28, 11.225, 280/11.19, 11.204, 11.221, 11.223, 11.231, 11.233, 11.27, 87.042

(56) References Cited

U.S. PATENT DOCUMENTS

| | | | | |
|---|---|---|---|---|
| 1,609,612 A | | 12/1926 | Eskeland | |
| 2,029,392 A | * | 2/1936 | Ruske | 208/173 |
| 2,644,692 A | * | 7/1953 | Kahlert | 280/11.22 |
| 3,951,422 A | | 4/1976 | Hornsby | |
| 3,963,252 A | | 6/1976 | Carlson | |
| 4,402,521 A | | 9/1983 | Mongeon | |
| 4,403,784 A | | 9/1983 | Gray | |
| 4,915,399 A | | 4/1990 | Marandel | |
| 5,085,445 A | | 2/1992 | Boyden | |
| 5,277,437 A | | 1/1994 | Moats | |
| 5,330,208 A | | 7/1994 | Charron et al. | |
| 5,393,078 A | | 2/1995 | Bourdeau | |
| 5,398,949 A | * | 3/1995 | Tarng | 280/11.22 |
| 5,536,025 A | | 7/1996 | Landay | |
| 5,551,713 A | | 9/1996 | Alexander | |
| 5,575,489 A | | 11/1996 | Oyen et al. | |
| 5,685,551 A | | 11/1997 | Zorzi et al. | |
| 5,704,621 A | | 1/1998 | Lazarevich et al. | |
| 5,823,543 A | | 10/1998 | Burns et al. | |
| 5,951,027 A | * | 9/1999 | Oyen et al. | 280/11.22 |
| 6,012,727 A | | 1/2000 | Chang | 280/11.28 |

OTHER PUBLICATIONS

US 5,630,598, 05/1997, Zorzi et al. (withdrawn)

* cited by examiner

*Primary Examiner*—Brian Johnson
*Assistant Examiner*—Bridget Avery
(74) *Attorney, Agent, or Firm*—Kolisch, Hartwell, Dickinson, McCormack & Heuser, PC

(57) ABSTRACT

Inline roller skates are provided with independent suspension systems, separately suspending one or more of a plurality of wheels. The wheels are mounted rotatably on axles, and the axles are held nominally parallel to the sole of the boot. The suspension systems include guides that maintain the axles parallel to the sole of the boot even as the wheels and axles move vertically in response to bumps and other forces.

68 Claims, 11 Drawing Sheets

HIGH PERFORMANCE SKATE

CROSS-REFERENCE TO RELATED APPLICATION

This application is a continuation-in-part of U.S. patent application Ser. No. 09/014,697, filed Jan. 28, 1998, and now abandoned, which is hereby incorporated by reference.

FIELD OF THE INVENTION

The present invention relates generally to skates, and more particularly to inline roller skates.

BACKGROUND

Inline roller skates, or simply inline skates, are boots with wheels mounted in a line under the sole of the boot. Some inline skates have wheels mounted to boots with some type of shock absorption system. For example, U.S. Pat. No. 1,609,612 to Eskeland, U.S. Pat. No. 5,330,208 to Charron et al., and U.S. Pat. No. 5,551,713 to Alexander all show skates with wheels supported through shock absorbing springs. Other patents, such as U.S. Pat. No. 5,536,025 to Landay and U.S. Pat. No. 5,575,489 to Oyen et al. show other shock absorbing systems.

The shock absorbing systems of the past, however, have provided shock absorption at the cost of decreased performance of the skate. Specifically, prior shock absorbing systems allow wheels to tilt when subjected to lateral forces, such as when a skater pushes the skate to the side to propel the skater forward, or when a skater turns or corners. Tilting of the wheels decreases the performance of a skate. The system disclosed in U.S. Pat. No. 5,536,025 to Landay, for example, discloses resilient cushions and axle end caps that allow wheels to tilt. The systems shown in U.S. Pat. No. 5,330,208 to Charron et al. and U.S. Pat. No. 5,575,489 to Oyen et al. include coil springs, disc springs or shock absorbing plugs that also allow the wheels to tilt. The systems of U.S. Pat. No. 1,609,612 to Eskeland and U.S. Pat. No. 5,551,713 to Alexander show skates with springs, ribs and slots that permit wheels to tilt.

Additionally, inline skates of the past have not included suspension systems that permit individual wheels to be adjusted so that different wheels may move up and down relative to the boot at varying spring rates. Such an adjustable system would increase the performance of a skate by providing shock absorption while also allowing a user to customize the skate for various skating maneuvers, such as allowing a skater to turn very sharply by leaning forward or back so that fewer than all the wheels of the skate contact the ground.

The present invention addresses these and other issues, and encompasses various embodiments of high performance skates.

DETAILED DESCRIPTION OF EMBODIMENTS OF THE INVENTION

Figure 1:
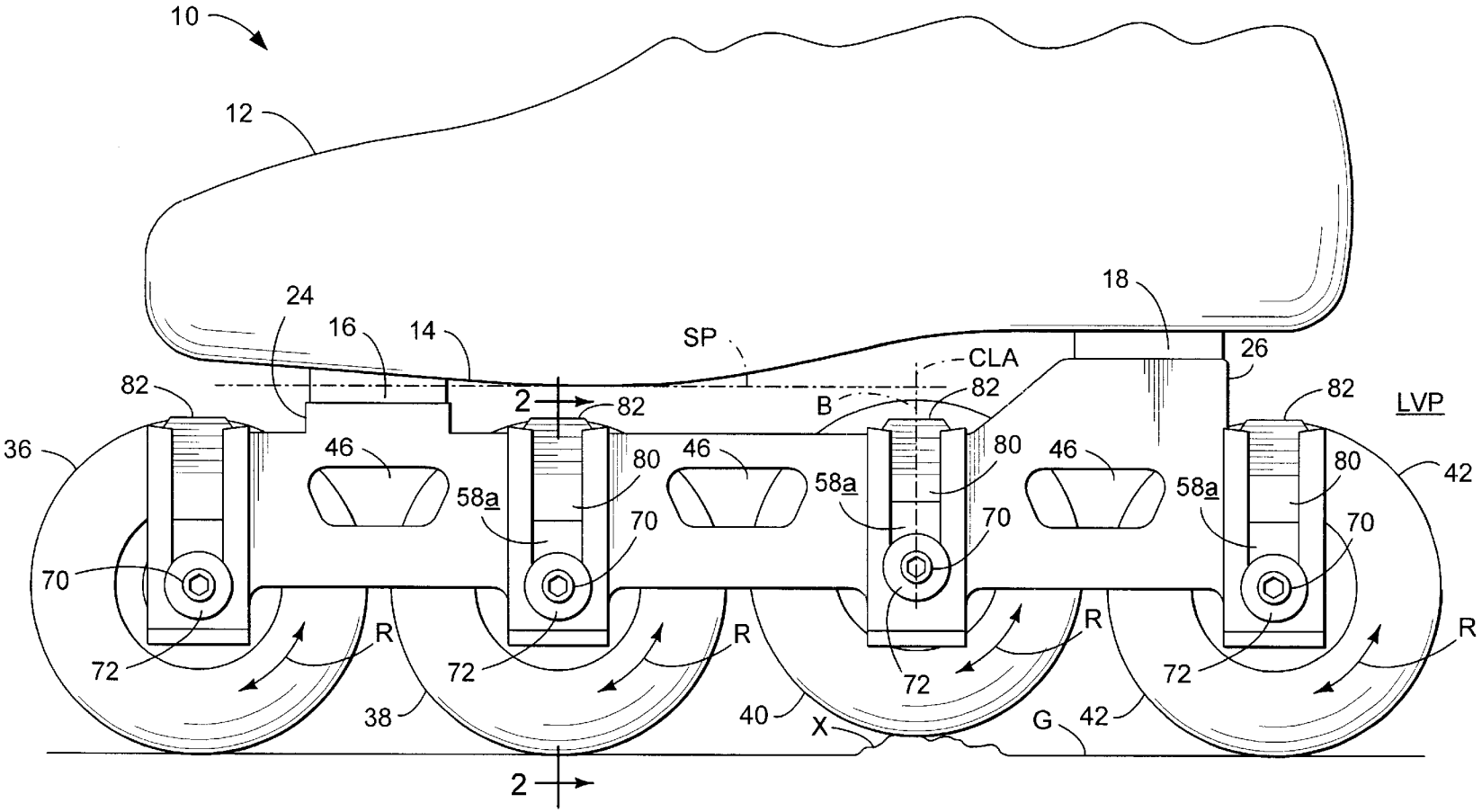
FIG. 1 shows one embodiment of an inline skate with four wheels and a wheel support or suspension system.

Referring to the drawings, a skate, indicated generally at 10, is shown in FIG. 1 which includes a boot 12 with a sole 14 generally defining a plane SP which is generally parallel to the ground G in a normal attitude of the skate. Front and rear mounting bases 16 and 18 are affixed on the boot sole, and a pair of vertically depending rails 20 and 22 (see FIG. 2) are bolted to mounting bases 16 and 18 at front and rear crossbars 24 and 26. Crossbars 24 and 26 interconnect rails 20 and 22. The crossbars and rails are preferably formed of a lightweight, but sturdy, engineering plastic, such as polycarbonate, or of any suitable material such as aluminum, or a composite material, e.g., glass fiber or carbon fiber-reinforced plastic. The rails may be called, or may form part of, an axle support or a frame.

Figure 2:
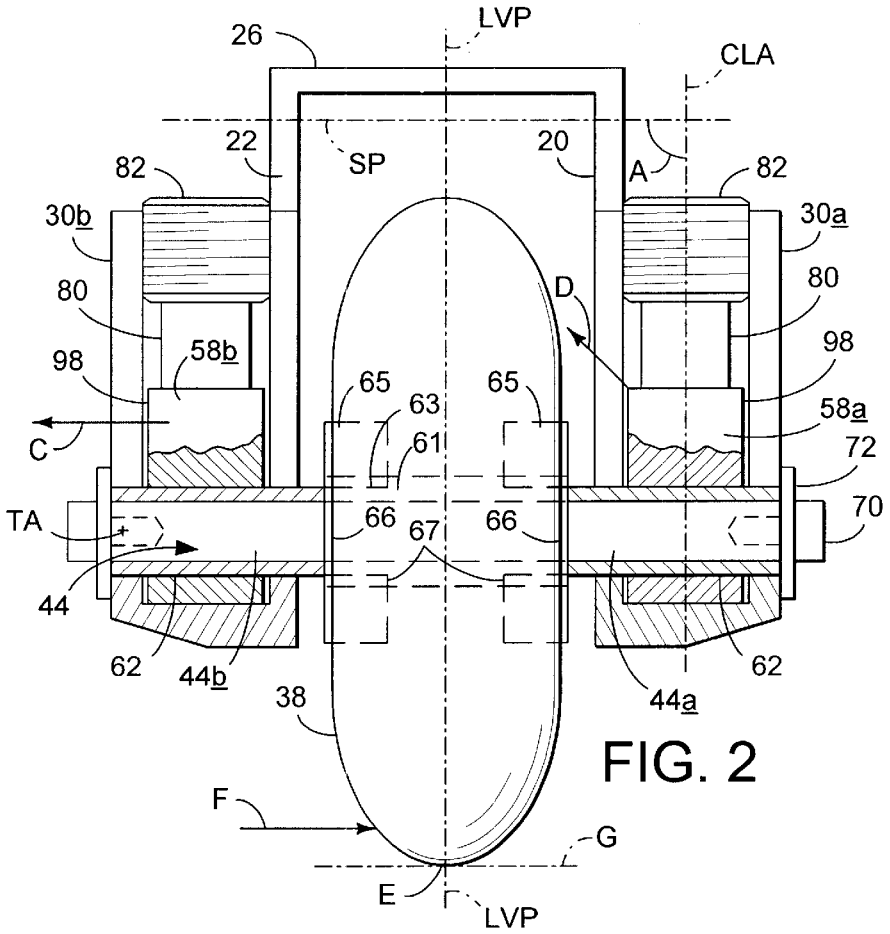
FIG. 2 shows a cross-section of a wheel taken along the line 2—2 in FIG. 1.
Figure 3:
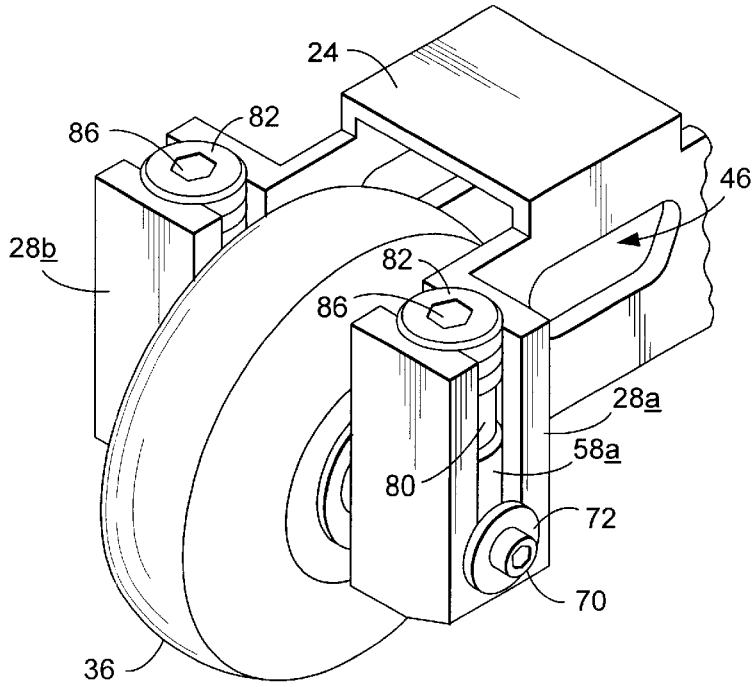
FIG. 3 shows a close-up view of a front axle-support and wheel.

The rails include four pairs of axle-suspension supports, one pair for each wheel. One pair is shown in FIG. 3 at 28*a* and 28*b*, and another pair is shown in FIG. 2 at 30*a* and 30*b*. The axle-suspension supports are typically spaced apart about 3 ¼ inches. Each support pair mounts an axle, such as axle 44 shown in FIG. 2, which is typically about 2 ¾ inches long and ¼ of an inch in diameter. Each axle mounts one of four inline wheels 36, 38, 40, and 42 for rotation, as shown by arrows R in FIG. 1, in a single longitudinal, generally vertically plane LVP which bisects the boot and the wheels as shown in FIG. 2. Plane LVP is parallel with the page in FIG. 1. Rails 20 and 22 also include three cutouts 46 to reduce the weight of the rails. The third wheel 40 from the front is shown colliding with, and recoiling from a bump X.

As shown in FIG. 2, axle 44 is mounted parallel to boot sole plane SP. Typically the front two axles are mounted about 1 ¾ inches below the sole while the third axle is about 2 ¼ inches below the sole and the rearmost axle is about 2 7/16 inches below the sole because the sole angles upwardly from a mid-region toward a slightly raised heel.

Figure 4:
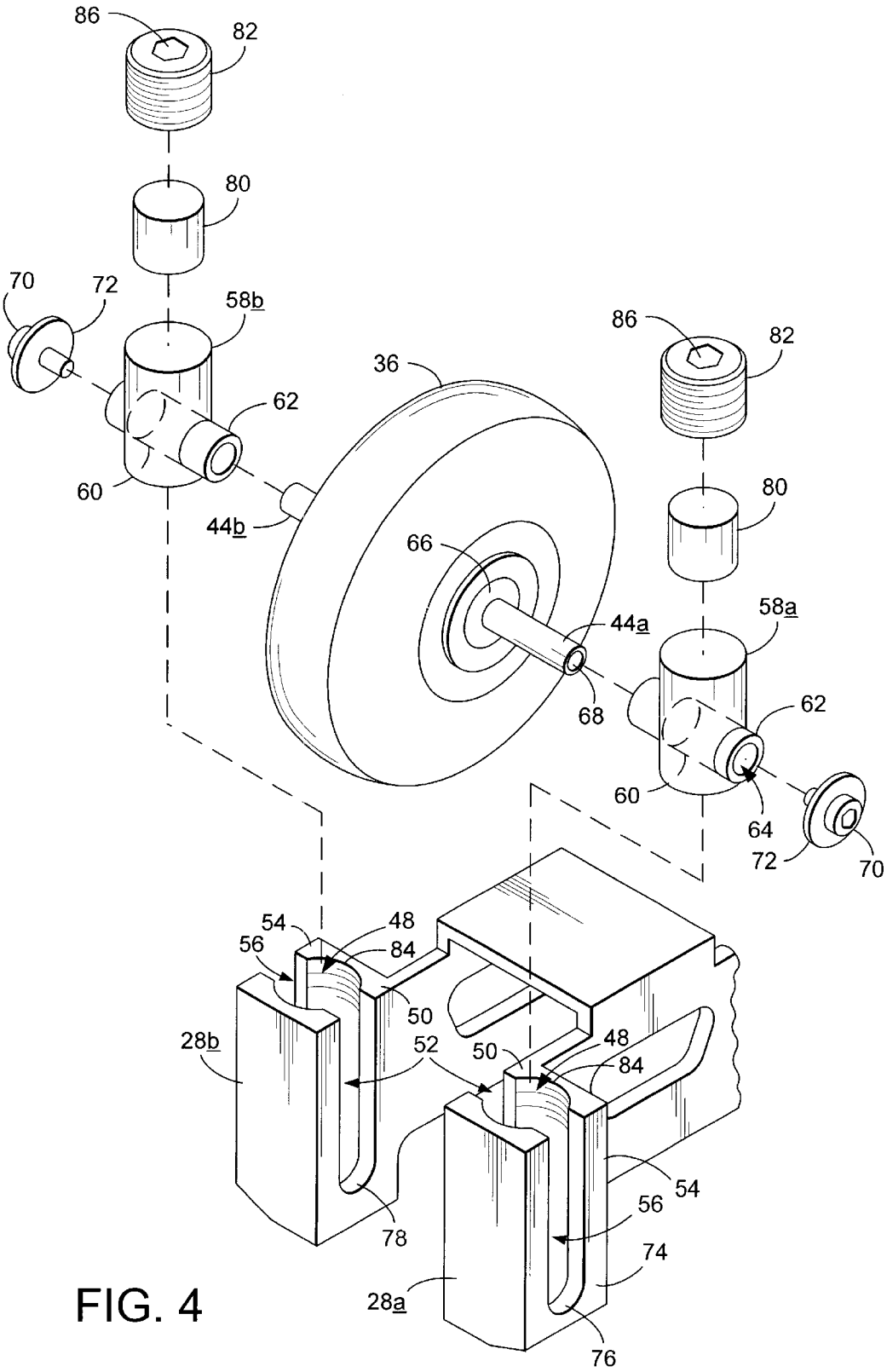
FIG. 4 is an exploded view of the wheel shown in FIG. 3.

As best seen in FIG. 4, each axle support, such as 28*a*, includes a central, generally vertical, elongate receptacle or channel 48, typically about 1 ⅞ inches long and about ⅝ of an inch wide, with an inside wall 50 defining a vertical aperture or slot 52 and an outside wall 54 defining a vertical slot 56. Both of vertical slots 52 and 56 are open on an upper end and typically are about ⅜ of an inch wide and 1 ½ inches high. Channel 48, which is shown being cylindrical but may have a rectangular or other suitable cross-section, receives a suspension guide, such as a compressor or piston 58*a* which is slidably movable within the channel and preferably formed of a hard plastic, such as acetal, which is known by the trade name DELRIN.

Piston 58*a* is typically about ¾ of an inch long and about ⅝ of an inch in diameter, but narrower than channel 48 by a clearance dimension 98. Clearance dimension 98 is shown greatly exaggerated in FIGS. 2 and 7, and is preferably between about 2/1000ths and 6/1000ths of an inch. A circular radial slot 60, typically about ⅜ of an inch in diameter, is defined through piston 58*a*, transverse to the longitudinal axis of the piston. A hollow, cylindrical sleeve or spacer 62, typically about ⅜ of an inch wide and 29/32 of an inch long, defining a central bore 64 typically about ¼ of an inch in diameter, is fixedly held in radial slot 60. A short rod (not shown) may be inserted through a lower end of the piston and into the outer wall of the sleeve to hold the sleeve more securely. Alternatively, the sleeve may be held in the piston slot by any suitable means, such as by an adhesive, or the piston and sleeve may be molded as a single piece and the central bore then drilled through the sleeve. If separately formed, the sleeve is preferably made of the same hard plastic, such as acetal, as is used for the piston. The material for piston 58*a* and sleeve 62 is chosen for a low coefficient of friction with the axle support material and the piston and sleeve may be lubricated by any suitable means, such as grease, further to reduce friction with channel 48. Piston 58*b* on the opposite end of axle 44 is identical to piston 58*a*.

Central bore 64 of sleeve 62 receives an end 44*a* of axle 44 and abuts a fixed hub 66 of wheel 38. The hub may be made of an axle spacer 61 through which the axle extends. Races 63 and bearings 65 are positioned on each end of axle spacer 61. Races 63 abut shoulders 67 on the axle spacer. The axle spacer and/or races constitute the hubs 66. As best seen in FIG. 2, the sleeves abutting fixed hub 66 on each side of the wheel prevents lateral movement of wheel 38 along axle 44, while allowing the wheel to rotate. As shown in FIG. 4, each end of axle 44 is provided with an internal thread 68 to receive a fastener, such as Allen bolt 70, to hold the axle in the axle support against any lateral movement. A washer 72, typically about ½ of an inch in diameter, is held onto each axle end by bolt 70 and bears against an outer surface 74 of each of the axle supports, as shown in FIGS. 2 and 3. Alternatively, bolt 70 could have a broad head to eliminate the need for separate washer 72. The sleeve and the bottom portion of the piston, along with the fasteners and washers, may be thought of as a guide system.

As best seen in FIG. 4, an outer stop 76 is provided at the lower end of each outer vertical slot 56 and an inner stop 78 is provided at the lower end of each inner vertical slot 52. Each axle is nominally biased against inner and outer stops 76 and 78 and away from the boot sole by a pair of shock absorbers, or compressible media such as elastomeric plastic pads 80, disposed in each channel 48 above each piston 58*a*. Alternatively, a spring or a combination of a spring and an elastomeric plastic pad may be used in the channel as a shock absorber. Pad 80 is typically between about 5/16 and ½ of an inch in diameter and about 7/16 of an inch long. The elastomeric plastic for the pad is preferably a polyurethane or other elastomeric polymer. The supports and stops are preferably integrally formed with the rails and of the same rigid material as the rails. The stops provide a lower boundary for axle vertical movement and nominally dispose the axle in the desired parallel or nearly parallel orientation relative to the boot sole.

Figure 5:
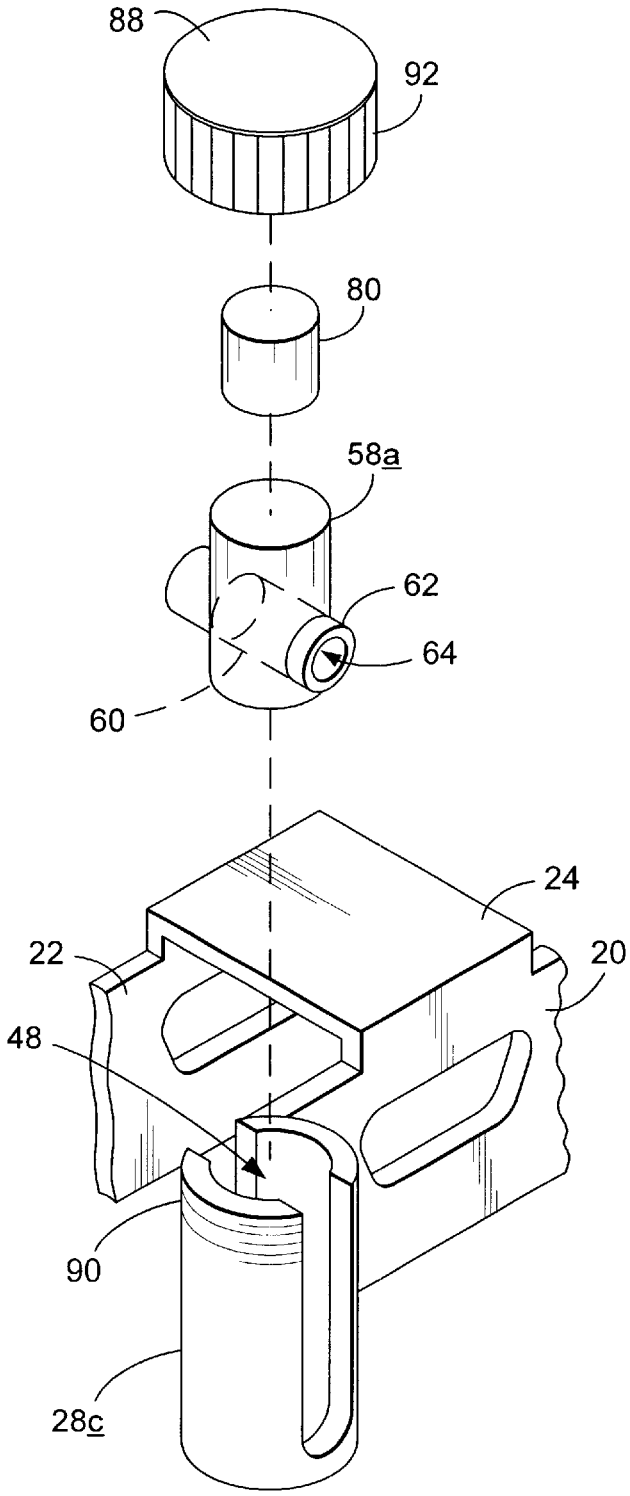
FIG. 5 is an exploded view of another embodiment of a suspension.

The shock absorber has a lower end pushing on the top of piston 58*a* and an upper end held against upward movement by a retainer, such as a threaded plug 82, screwed into place in internal threads 84 in channel 48. Threaded plug 82 may be provided with a suitable tool-drivable interface, such as Allen interface 86, or with finger-operable wings, as for a wing-nut. Alternatively, as shown in FIG. 5, an internally threaded cap 88, screwed onto external threads 90 on an axle support 28*c* with cylindrical outer walls, may be used to retain shock absorber 80 in channel 48. Cap 88 is preferably provided with a grip-enhanced outer surface, such as ribs 92, which allows the skater to adjust with the fingers the height of the cap, and thus the pre-compression of the shock absorber. Alternatively, the cap could be provided with a tool-drivable surface, e.g., a hex head or Allen interface.

As best seen in FIG. 1, channel 48 has a longitudinal axis CLA that intersects with the plane SP of the boot's sole and forms a channel angle B that is parallel with plane LVP. Angle B often is about 90°. As best seen in FIG. 2, the longitudinal axis CLA of channel 48 also forms a channel angle A that is transverse to plane LVP when axis CLA intersects plane SP. Angle A often is about 90°. Alternatively, channel angles A and B may be designed to be greater or less than 90° to adapt the skate to different styles and environmental conditions of skating, but the guides and channels will still work to maintain the axles in a fixed attitude relative to the boot sole.

Figure 6:
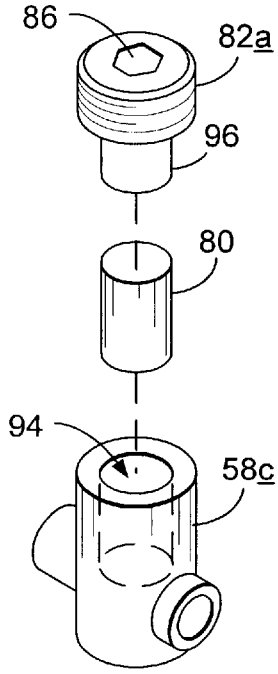
FIG. 6 is an exploded view of components usable in embodiments of the invention.

An alternative embodiment for the piston and shock absorber is shown in FIG. 6 where a piston 58*c* is provided with an internal hollow or recess 94 which receives an end or all of shock absorber 80. Retainer 82*a*, which is shown as a plug but which could be a cap, includes a lower, depending extension 96 that extends into piston hollow 94 to hold shock absorber 80 against upward movement. This embodiment allows piston 58*c* to be taller and to bear against channel 48 a greater distance from axle 44 without increasing the distance of the axle from the boot sole. For skating comfort and stability, the distance between the boot sole and the axle is best kept close to a minimum distance needed for wheel clearance.

Figure 7:
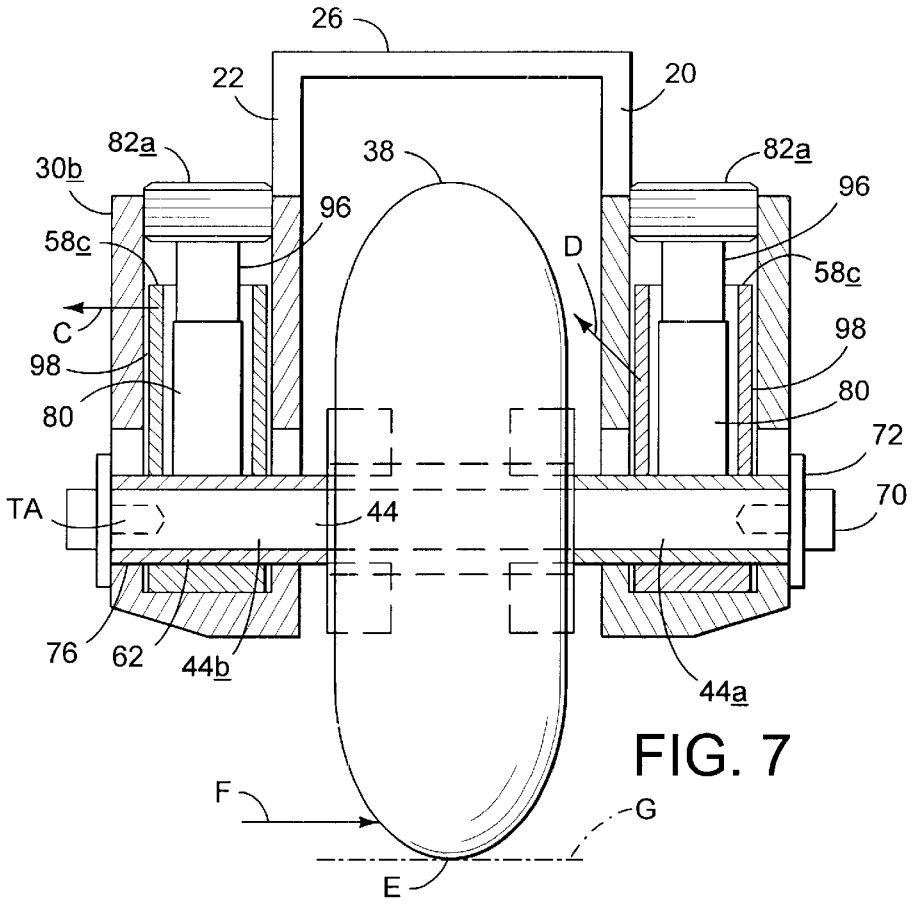
FIG. 7 shows a cross-section of an embodiment of the invention with the components of FIG. 6.

The advantage of a greater distance from axle 44 for the piston's bearing against the channel will become apparent from studying the suspension's geometry as shown in FIG. 7. The same advantage is present in the embodiment of FIG. 2, but the placement of pad 80 within the piston allows the piston to be taller without increasing the distance between axle 44 and the sole of the boot. That is, the piston in the embodiment of FIG. 7 maximizes the ratio of the height of the piston to the separation of the axle and sole. With a boot-sole-to-axle distance of about 1 ¾ inches, piston 58*c* may be about 1 ¼ inches long or longer, for a ratio of piston-height to axle-sole separation of 5/7 or greater.

As shown in FIG. 7, pistons 58*c* on each end of axle 44 are slidably movable within channel 48 because both are slightly smaller in diameter or cross-section than channel 48 by clearance dimension 98. The clearance allows each piston 58*c* to move along channel 48, but keeps piston 58*c* in substantially fixed alignment with the axis of the channel. The clearance dimension for the embodiment shown in FIG. 7 is preferably about 2/1000ths to 6/1000ths of an inch, as it is for the embodiment of FIG. 2.

The skate wheels are constantly subjected to forces from the skater's pushing or turning and from bumps. These forces include both vertical and lateral components. The lateral component is illustrated by arrow F in FIGS. 2 and 7. Lateral force F tends to cause axle 44, which at end 44*b* is biased downward against outer stop 76, to rotate counterclockwise about a tilting rotation axis TA. As axle 44 rotates about axis TA, the piston connected at end 44*b* is pushed across the dimension as shown by arrow C. Once the piston moves laterally across the clearance dimension, the piston's outer surface stops against the wall of channel 48 and the piston's fixed connection to axle 44 through sleeve 62 prevents further tilting rotation of axle 44. Also, as the lateral force F is applied to the wheel and axle 44 tilts, the piston connected at end 44*a* moves upwardly and to the left across the clearance dimension as shown by arrow D, similarly stopping further tilting once the piston crosses the clearance dimension. Of course, the wheel is similarly prevented substantially against tilting in an opposite, clockwise direction on an axis at axle end 44*a*.

The advantageous effect of the pistons' being constrained by the channels is realized at the wheel, where tilting of the wheel out of longitudinal, generally vertical plane LVP is restricted to a distance closely related to the clearance dimension. For example, as shown in FIG. 7, the piston closer to the axle extends up to a maximum distance from axle end 44*b* that is about one-half the distance between axle end 44b and a point of contact E of the wheel with ground G. Thus, the near piston allows the wheel to tilt out of plane LVP by about twice the clearance dimension. For a clearance dimension of about 2/1000ths of an inch the wheel can tilt only about 4/1000ths of an inch, but such tilting is substantially within the longitudinal vertical plane and the axle remains substantially parallel to the plane of the sole as defined herein. Meanwhile, the far piston is farther from axle end 44*b*, but is also moved somewhat upwardly by lateral force F so that the far piston limits the wheel movement to about the same degree as the near piston. The pistons can be designed to extend farther from axle 44 than shown in FIG. 4, thus further limiting the tilting of the wheel to no more than about the clearance dimension.

Axles 44 are nominally disposed against stops 76 and 78 in an initial, fully extended position when no forces, lateral or vertical, are exerted on the axles. Preferably, all the axles are parallel to one another in the fully extended position. When forces having vertical and lateral components are exerted on the axles, the suspension guides allow the axles to move in reaction to the forces while maintaining the axles substantially parallel to the initial position. Wheels 36, 38, 40 and 42 are mounted on axles for rotation about the axles and are in an initial position in a longitudinal, generally vertical plane when no forces, lateral or vertical, are exerted on the wheels. When forces having vertical and lateral components are exerted on the wheels, the axles and suspension guides allow the wheels to move in reaction to the forces while maintaining the wheels substantially in the plane of the initial position of the wheels.

Figure 8:
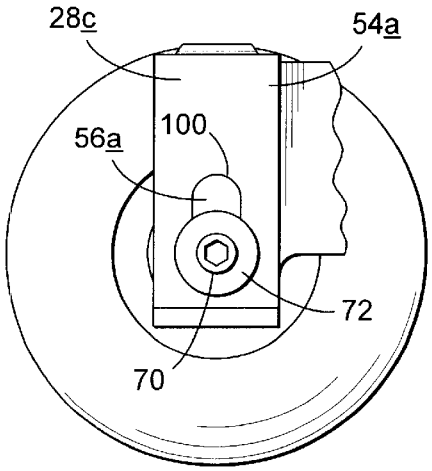
FIG. 8 is a side view of the embodiment shown in FIG. 7.

FIG. 8 shows an alternative embodiment for an axle support 28*c* wherein a vertical slot 56*a* includes an upper stop 100 rather than being open to the top of the support. The vertical aperture or slot on the inner wall of support 28*c* may be likewise provided with an upper stop. Stop 100 provides an upper limit for axle travel and a solid wall 54*a* provides a larger bearing surface for the piston, more securely to hold the piston against lateral movement. This embodiment requires that the sleeve be inserted in the piston's radial slot only after the piston is installed in the channel while the other embodiment allows a pre-connection or single-molding of the piston-sleeve combination which can then be installed from the top of the channel. Another embodiment allowing installation of the piston-sleeve combination includes a vertical slot extending to an open end at the bottom of the axle support and a bracket releasably installable over the bottom of the support to close off the bottom of the support and to provide the lower stops 76 and 78.

Figure 9:
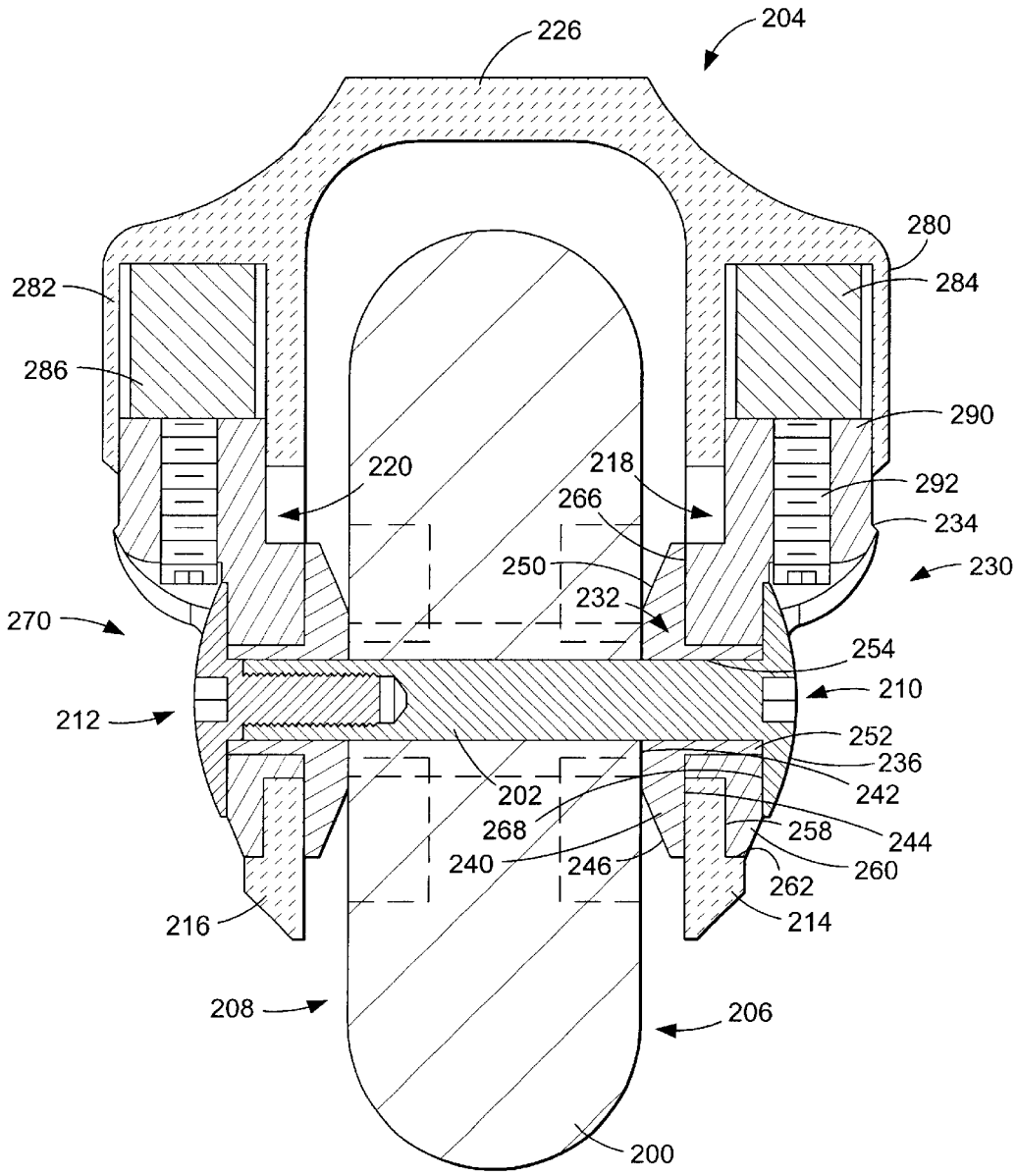
FIG. 9 is a cross-sectional view of another embodiment of the invention.
Figure 10:
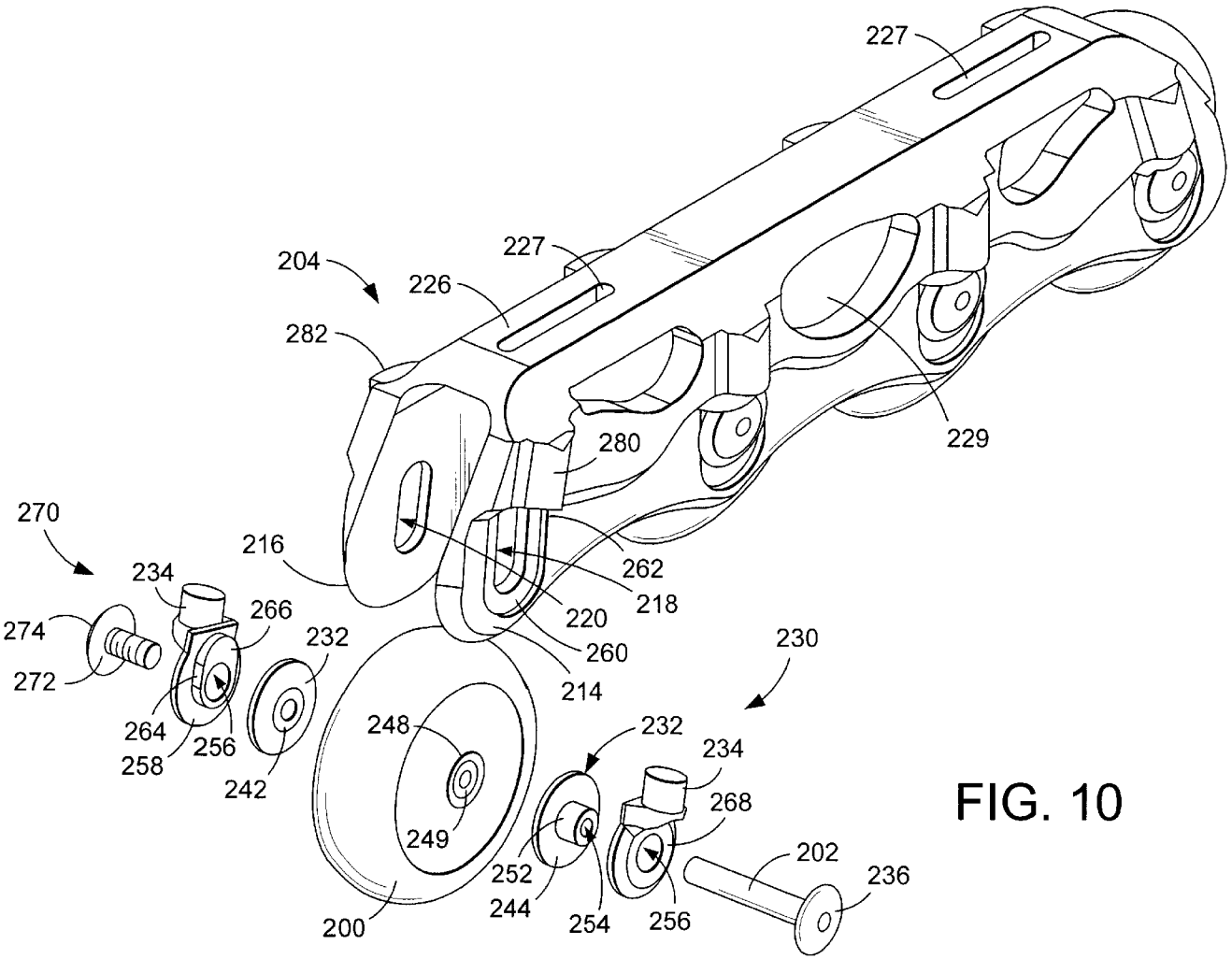
FIG. 10 is an exploded view of the embodiment shown in FIG. 9.

FIG. 9 shows a cross-sectional view of another embodiment of the invention, and FIG. 10 shows an exploded view of that same embodiment. A wheel 200 is shown in FIG. 9 mounted on an axle 202 in an axle support 204. Wheel 200 includes a first side 206 and a second side 208, and axle 202 extends through the wheel from one side to the other. A first end 210 of the axle extends from the first side of the wheel, and a second end 212 of the axle extends from the second side of the wheel. Axle support 204 supports the ends of the axle to hold the wheel to the skate.

Axle support 204 includes a first portion 214 extending along side 206 of wheel 200, and a second portion 216 extending along side 208 of the wheel. The first and second portions of axle support 204 may be thought of as blade-like structures that are rigid, solid pieces of material. A blade-like structure is desired in some embodiments because it minimizes the width or side-to-side dimension of the skate. A minimal side-to-side dimension is important to provide clearance when a user leans into a turn. A skate with a large side-to-side dimension may scrape along the ground if a user leans too far into a turn. A blade-like structure also provides rigidity to the support, especially in the direction of the length of the blade-like structure.

The first and second portions 214 and 216 of axle support 204 are connected by a web portion 226, as shown in FIG. 9. The axle support, with its first and second portions and its web portion, may be thought of as a frame.

Axle support 204 may be one piece, with the first and second portions integral with the web portion. Axle support 204 may be made by molding plastic or by machining either plastic or metal, such as aluminum. An integral axle support provides rigidity for the support to enhance the performance of the skate, and it also facilitates the manufacture and assembly of the skate. The axle support is mounted to the sole of a boot or to some other foot attachment structure, such as toe and heel clamps, by bolts extending through slots 227, or in any other known manner.

Figure 21:
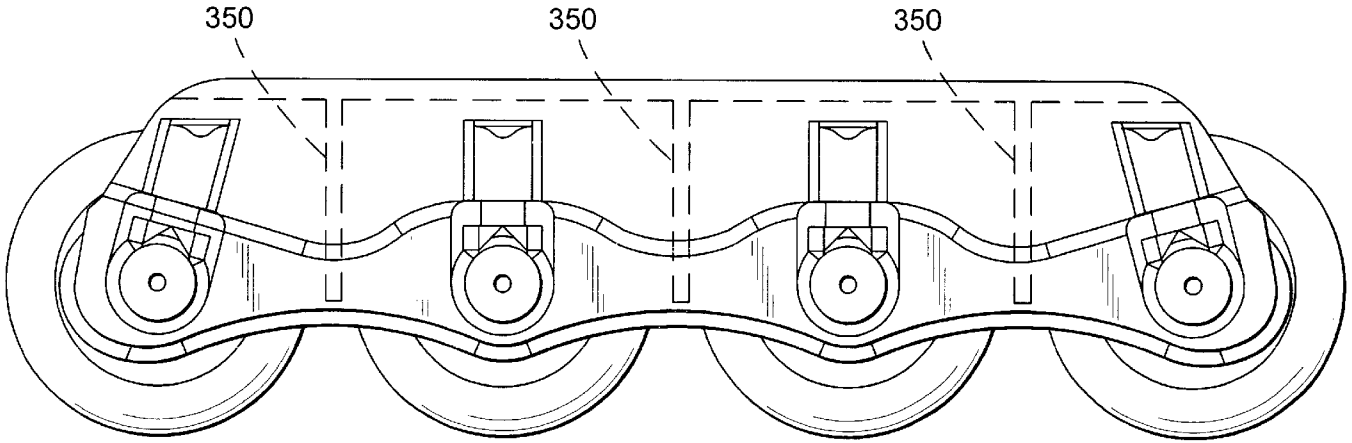
FIG. 21 is another embodiment of the invention.

The axle support typically is elongate, as shown in FIG. 10, and the first and second portions of the axle support often extend along the entire length of the support to create rails or side walls. Crossbars or ribs may extend between the side walls at various locations along the length of the support to give the support increased strength and rigidity. For example, crossbars may be positioned along the length of the support between the wheels, as shown in dashed lines at 350 in FIG. 21. Alternatively or additionally, the support may include cutouts, such as cutout 229 in FIG. 10, at various locations to decrease the weight of the support.

An axle support also may be split into two sections, one for the toe of the skate and another for the heel, as in Klop type skates. This split frame provides flexibility for the foot during skating, and allows wheels to track the shape of the bottom of the boot, resulting in the wheels staying in contact with the ground longer during strokes.

First and second portions 214 and 216 of axle support 204 include apertures 218 and 220. These apertures extend through the first and second portions of the axle support, respectively, and they hold the wheel in place by supporting the two ends of the axle. Specifically, first end 210 of the axle extends through aperture 218, and second end 212 of the axle extends through aperture 220.

Apertures 218 and 220 are sized so that axle 202 may move up and down relative to the sole of the skate to absorb vibrations and shocks, and to provide various skating characteristics, but the axle may not move toward the toe or heel of the skate. This is best seen in FIG. 10, which shows axle support 204 and first and second portions 214 and 216 of the axle support. FIG. 10 also shows an exploded view of wheel 200 and the parts that mount wheel 200 to the axle support. Apertures 218 and 220 are shown in the first and second portions of the axle support. The apertures, in the embodiment depicted in FIG. 10, have an oval, elongate shape. In the embodiment shown in FIGS. 9 and 10, apertures 218 and 220 are each approximately 1 inch long, from top to bottom, and approximately ½ inch wide, from front to back. The apertures are sized so that axle 202 may not move along the length of the axle support. The axle may, however, move up and down in the axle support because apertures 218 and 220 are sized to permit that motion. Of course, apertures 218 and 220 may take various shapes, such as a rectangular shape, which, in some cases, is desired to help prevent the axle from moving forward and backward or from rotating.

The axle is mounted in apertures 218 and 220 by guides or guide systems, such as first guide system 230. First guide system 230 mounts first end 210 of axle 202 into aperture 218, as shown in FIG. 9. A guide system may include one component, or two or more components working together. First guide system 230, and a second guide system 270, are shown in FIG. 10 in an exploded view. Second guide system 270 mounts second end 212 of axle 202 into aperture 220. Second guide system 270 is the same as first guide system 230, and the following discussion of first guide system 230 applies equally to second guide system 270. Corresponding parts of the first and second guide systems are given common reference numbers in the following discussion.

First guide system 230 includes a spacer 232, the bottom portion of a compressor 234 and an axle head 236. First guide system 230 is configured to contact axle 202. The guide system is also configured so that at least a portion of the system extends into aperture 218, and at least a portion of the system contacts wheel 200 to hold the wheel at a substantially fixed position away from axle support 204. These limitations to the guide system provide lateral stability to wheel 200 during skating. These limitations may be accomplished in several ways.

In the embodiment shown in FIGS. 9 and 10, spacer 232 includes a circular, disk-shaped head portion 240 that has a first surface 242 that contacts wheel 200. Head portion 240 also includes a second surface 244 that is configured to contact and slide along an inner surface 246 of first portion 214 of axle support 204. As shown in FIG. 9, surface 242 is sized to contact wheel 200 at a stationary portion of the wheel's hub, such as along bearing race 248 or along axle spacer 249 shown in FIG. 10, and as discussed above in connection with the embodiment shown in FIG. 2. In this manner, surface 242 contacting race 248 or axle spacer 249 does not impede the rotation of the wheel. For example, first surface 242 of spacer 232 may be circular or ring-like in shape and have an outer diameter of approximately ½ of an inch. Second surface 244 of spacer 232 is typically larger in area than first surface 242. Second surface 242 is sized sufficiently large to provide a contact surface with the first portion 214 of axle support 204 to help maintain lateral stability of the wheel. For example, second surface 244 may be circular or ring-like in shape, and have an outer diameter of approximately 1 inch. Head portion 240 of spacer 232 has a predetermined thickness that holds wheel 200 a given distance away from the axle support. In the depicted embodiment, head portion 240 holds the first side 206 of wheel 200 approximately ⅛ of an inch from the first portion 214 of the axle support. Spacer 232 includes a surface 250 which extends between first surface 242 and second surface 244 to provide the disk-shaped head portion 240. Of course, spacers may take many different configurations and shapes, and are not limited to disk shapes.

Spacer 232 also includes a neck portion 252 that extends away from head portion 240. In the embodiment shown in FIGS. 9 and 10, neck portion 252 extends approximately ¼ of an inch away from head portion 240. An aperture 254 extends through neck portion 250 and through head portion 240, allowing an axle to be inserted through the spacer, as shown. In this manner, spacer 232 is associated with and mounted directly to the axle. Neck portion 252 extends along the axle to prevent the spacer from tilting and to provide stability for the spacer. When assembled, neck portion 252 of the spacer extends into aperture 218. In some embodiments, such as the embodiment depicted in FIG. 9 and 10, at least a portion of the spacer extends not only into aperture 218, but through the aperture.

Spacer 232 may be made from metal or a composite plastic. Typically, the spacer is aluminum. The spacer should be stiff or rigid.

First guide system 230 also includes the bottom portion of compressor 234. The bottom portion of compressor 234 includes an aperture 256, best shown in FIG. 10. Aperture 256 is sized to fit over and around neck portion 252 of spacer 234. In this manner, compressor 234 is associated with and mounted on spacer 232 and axle 202.

The bottom portion of compressor 234 includes a first surface 258 that is configured to contact and slide along an outer surface 260 of fist portion 214 of the axle support. First surface 258 may be circularly shaped and have a diameter of approximately 1 inch. The contact between first surface 258 and outer surface 260 provides further support and lateral stability to guide system 230, and functions to prevent wheel 200 from tilting.

As best shown in FIG. 10, outer surface 260 of first portion 214 of the axle support is somewhat recessed. This recess provides a lip 262 that surrounds the compressor to help position the compressor and to help keep guide system 230 from moving toward the toe or heel of the skate. Outer surface 260 and its associated recess are oval shaped in the depicted embodiment, having a top to bottom length of approximately 1 ¼ inches and a front to back width of approximately 1 inch. Of course, outer surface 260 and its recess may take many different shapes, such as a rectangular shape. First surface 258 of the compressor is shaped to contact outer surface 260 and to fit in the recess of outer surface 260. For example, first surface 258 of the compressor may include a portion that is substantially circular in shape and that has a diameter of approximately 1 inch.

The bottom portion of compressor 234 also includes an insert section 264 that extends away from first surface 258, and into aperture 218 of the axle support, as shown. Insert section 264 is shaped to correspond to aperture 218 to position the compressor and to provide stability to the guide system and wheel. In FIGS. 9 and 10, insert section 264 is oval to correspond to the oval shape of aperture 218. The insert section would be rectangular if the aperture was rectangular. The insert section, however, is not as long as the aperture so that the insert section may move up and down in the aperture. For example, the insert section may be approximately ¾ of an inch in length from top to bottom, and approximately ½ of an inch in width from front to back. The insert section may extend away from first surface 258 approximately $\frac{1}{8}^{th}$ of an inch.

Insert section 264 terminates in a contact surface 266. That contact surface abuts second surface 244 of spacer 232 when the guide system is assembled, as shown in FIG. 9. When contact surface 266 abuts second surface 244 of the spacer, a pocket is formed between second surface 244 of the spacer and first surface 258 of the compressor. This pocket sandwiches first portion 214 of the axle support, as shown in FIG. 9. The side-to-side dimension of the pocket is defined by the distance insert section 264 extends away from first surface 258 of the compressor. Typically, the side-to-side dimension of the pocket is approximately 2/1000ths to 3/1000ths of an inch greater than the side-to-side thickness of first portion 214 of the axle support, and usually no more than 5/1000ths of an inch greater, although larger dimensions are possible. The side-to-side dimension of the pocket is the distance between second surface 244 of the spacer and first surface 258 of the compressor, which, in the embodiment shown in FIG. 9, are parallel surfaces. The pocket has a sliding fit with first portion 214 of axle support 204, and the side-to-side dimension of the pocket provides the sliding fit while still allowing second surface 244 of the spacer and first surface 258 of the compressor to contact first portion 214 to provide lateral stability to the wheel.

The bottom portion of compressor 234 also includes an outer surface 268, configured to abut axle head 236. The thickness of the bottom portion of compressor 234 between outer surface 268 and contact surface 266 is somewhat greater than the length of neck portion 252 of spacer 232. This greater thickness allows the guide system to be held tightly together while maintaining the side-to-side dimension of the pocket that sandwiches the axle support.

Compressor 234 may be made of a hard plastic or metal, such as aluminum.

The surfaces in the guide systems that contact and slide along the axle support may be referred to as support surfaces.

As shown in FIG. 9, axle 202 extends through first guide system 230, and axle head 236 abuts outer surface 268 of the bottom portion of compressor 234. The axle then extends through wheel 200 and through second guide system 270. An axle bolt 272, which includes a bolt head 274 that bears against second guide system 270, is threaded into a threaded socket at the second end of the axle, as shown in FIG. 9. The axle bolt is then tightened, such as by an Allen wrench, causing the components of the first and second guide systems to draw tightly together. Tightening the axle bolt also causes the spacers in the guide systems to firmly contact wheel 200 and hold it tightly in place. Because of how the guide systems contact the wheel, how the surfaces in the guide systems contact each other, and how the side-to-side dimensions of the pockets in the guide systems are fixed, the axle bolt may be greatly tightened without restricting the movement of the wheel and without restricting the ability of the guide systems to slide up and down on the axle support. This, in turn, allows the guide systems to provide significant stability to the wheel without sacrificing performance by allowing the wheel to tilt.

Axle support 204 also includes first and second receptacles 280 and 282. The receptacles are regions that hold compressible media in positions to be compressed. The compressible media bias the wheel down, away from the boot of the skate, while still allowing the wheel to absorb shocks and/or to provide various performance characteristics.

Receptacles 280 and 282 shown in FIGS. 9 and 10 are socket-like structures integral with axle support 204. Receptacles that are integral with the axle support facilitate the assembly and manufacture of the skate, and reduce the number of parts required for the skate. Nevertheless, non-integral receptacles may be used. Receptacles 280 and 282 are shown positioned on first and second portions 214 and 216 of the axle support. The receptacles are also positioned outwardly from the first and second portions of the axle support, and above the axle. This positioning allows the axle support and the assembled wheel to maintain a minimal side-to-side dimension to provide clearance for the wheel during sharp, leaning turns of the skate. Receptacles may be positioned at different positions, such as within the thickness of a portion of the axle support. Receptacles 280 and 282 typically are approximately ½ of an inch deep.

Receptacle 280 receives a first compressible medium 284, and receptacle 282 receives a second compressible medium 286. In the embodiments shown in FIG. 9, the compressible media are made of a deformable material, such as a urethane or other elastomeric polymer. Of course, other compressible media may be used, such as springs, gas, etc., as well as combinations of compressible media. Different media may require modifications to the structure of the receptacles and other related components.

Compressor 234 includes a head portion 290 that extends into receptacle 280 and contacts compressible medium 284. Head portion 290 is sized so that it fits within receptacle 280 and may slide up and down in the receptacle. A similar compressor and head portion is associated with compressible medium 286 and receptacle 282. The compressors are associated with and mounted on axle 202 as described above. Compressible media 284 and 286 press against the compressors and bias the compressors down, away from the boot of the skate, and the compressors, in turn, bias the axle and wheel down.

In use, when the wheel encounters a bump or rough ground, the impact of the wheel against the bump may force the wheel, axle and guide systems up, toward the boot of the skate. The wheel, axle and guide systems move or slide up toward the boot of the skate in the apertures in the axle support. The compressors also move up when the wheel and axle move up because the compressors are associated with and mounted on the axle. When the compressors move up, they compress the compressible media in the receptacles, thereby dampening the shock of the bump. In this manner, the skate absorbs vibrations and shocks. The wheel, however, remains vertical relative to the skate and does not tilt because of the guide systems described above.

Compressible media 284 and 286, shown in FIG. 9, are pieces of deformable, elastomeric material. The pieces are sized so that they may deform and bulge within receptacles 280 and 282, respectively, when compressed. In other words, there is sufficient space surrounding the compressible media within the receptacles to allow the media to bulge outwardly during compression.

The degree and rate of up and down movement of the wheel permitted by the compressible media may be varied and/or limited by sizing and/or shaping the compressible media. For example, a cylindrically shaped piece of elastomeric material will produce a different spring rate than a frusto-conical shaped piece. The degree and rate of up and down movement of the wheel also may be varied or limited by sizing the receptacles in such a way that the bulging of the compressible media is restricted when a certain amount of compression is reached. In other words, a piece of deformable, elastomeric material may be sized so that there is little space between it and the walls of the receptacle. The material may be compressed until it bulges outward and contacts the walls of the receptacle, after which it will not be allowed to bulge further because of the walls of the receptacle. Different types of compressible media also may be used to produce different spring rates.

The up and down movement of the wheel shown in FIG. 9 also may be limited by pre-compressing the compressible media. Compressor 234 in FIG. 9 includes a threaded adjustment bolt 292 that extends through a threaded hole in head portion 290 of compressor 234. The compressor associated with receptacle 282 includes a similar bolt. Bolt 292 may be threaded into head portion 290 so that the bolt extends beyond the upper surface of the head portion. The bolt would then pre-compress medium 284 so that any further compression of the medium would require greater force. In this manner, the ability of wheel 200 to move up and down or to absorb shocks may be adjusted. This may be described as the compressibility of the compressible media being adjustable. (The embodiment shown in FIG. 10 does not include the adjustment bolts from FIG. 9, or the threaded holes in the compressors.)

FIG. 10 shows an axle support and four wheels configured to move up and down. Any one or more of the wheels may include an adjustment mechanism to adjust the ability of a wheel to move up and down. For example, the skate may be adjusted to have stiffer shocks in the front and rear, and softer shocks in the middle, or vice versa. Different settings provide different performance characteristics.

Figure 11:
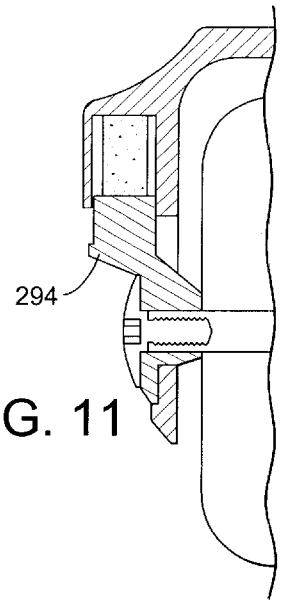
FIGS. 11–17 all show various embodiments of the invention.

FIG. 11 shows another embodiment of the invention. This embodiment is similar in concept to the embodiment shown in FIGS. 9 and 10, but different in components. FIG. 11 includes a compressor 294 having a bottom portion that is directly mounted on an axle and that extends through an aperture in an axle support to contact a wheel. This embodiment combines the spacer shown in FIGS. 9 and 10 with the bottom portion of the compressor. This embodiment provides a surface that slides against an outer surface of an axle support.

Figure 12:
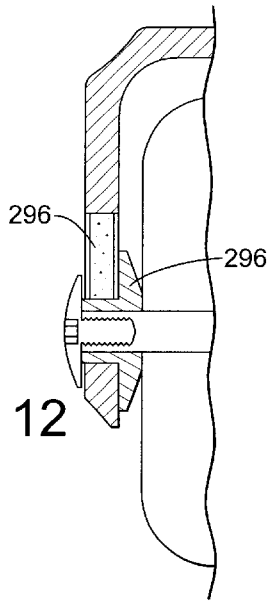

FIG. 12 shows another embodiment of the invention. In this embodiment, a compressible medium 296 is positioned within an aperture extending through a portion of an axle support. A spacer 298 extends along an axle and through the aperture, and includes a head that contacts and slides against the axle support. The spacer also contacts a wheel and the compressible medium. A head of an axle bolt works with the spacer to provide a pocket that sandwiches a portion of the axle support. The head of the axle bolt and the head of the spacer both include surfaces that slide against the axle support. It is important in this embodiment that the spacer and head of the axle bolt be rigid and sufficiently large, particularly relative to the aperture, so that they can provide the stability required to prevent the wheel from tilting. A head on the end of the axle opposite the axle bolt may function like the axle bolt for a guide system on that end of the axle. The head of the axle bolt and the head of the axle may be thought of as members associated with the axle that have surfaces that contact and slide along the axle support.

Figure 13:
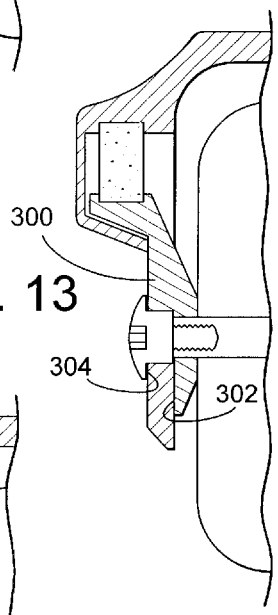

FIG. 13 shows another embodiment of the invention. This embodiment includes a compressor 300 having a bottom portion that is directly mounted on an axle and that extends through an aperture in an axle support to contact a wheel. The compressor includes a surface 302 that slides against the inside of the axle support. An axle bolt includes a head portion with a surface 304 that slides along the outside of the axle support. These two surfaces define a pocket that sandwiches the axle support.

Figure 14:
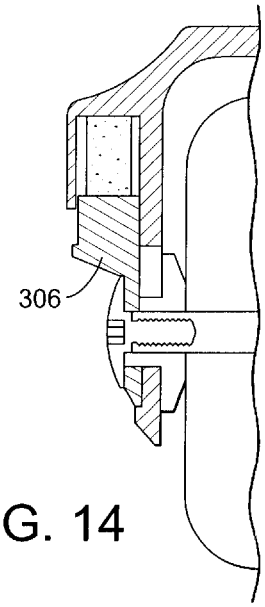

FIG. 14 shows still another embodiment of the invention. This embodiment is similar to the embodiment shown in FIGS. 9 and 10, except that the bottom portion of compressor 306 is configured so that it does not extend through the aperture to contact the spacer.

Figure 15:
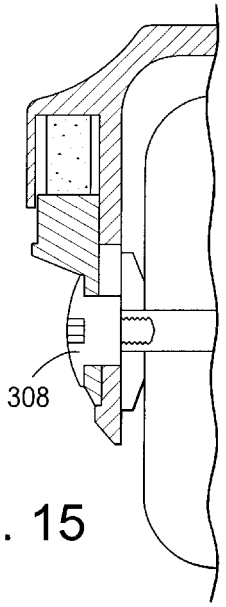

FIG. 15 also shows an embodiment similar to the embodiment shown in FIGS. 9 and 10, except that an axle bolt 308 extends into an aperture in an axle support to contact a spacer. The bottom portion of the compressor and the spacer are configured somewhat differently. In this embodiment, the axle would include a shoulder at its other end similar to axle bolt 308.

Figure 16:
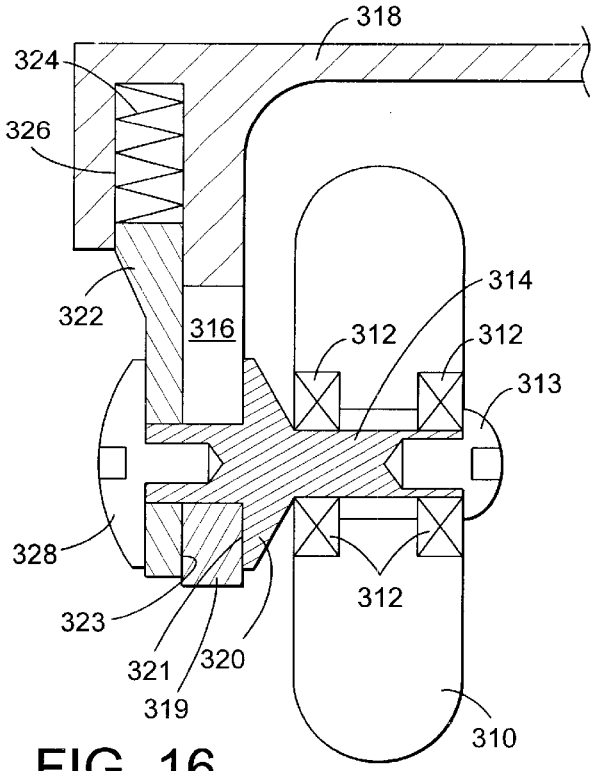

FIG. 16 shows an embodiment of the invention with a cantilever design. This embodiment includes a wheel 310 mounted to an axle 314 by bearings 312 and by a first axle bolt 313. An axle support 318 includes a single, blade-like structure 319 that extends along one side of the wheel. The axle extends in a cantilever fashion away from blade-like structure 319. The axle includes a spacer 320 that is integral with the axle. The spacer includes a surface 321 that contacts and slides along a portion of the axle support, as shown. The spacer also contacts the wheel and holds it a fixed distance from the axle support. The spacer, or what may be thought of as the combined spacer/axle structure, extends into and through aperture 316. A compressor 322 includes a bottom portion mounted to the spacer/axle structure, and a head portion bearing against a spring 324 in a receptacle 326. The bottom portion of the compressor includes a surface 323 that contacts and slides along a portion of the axle support, as shown. Surface 323 of the bottom portion of the compressor and surface 321 of the spacer define a pocket that sandwiches the axle support. A second axle bolt 328 is threaded into the axle adjacent the spacer. Second axle bolt 328 holds the assembly together.

Figure 17:
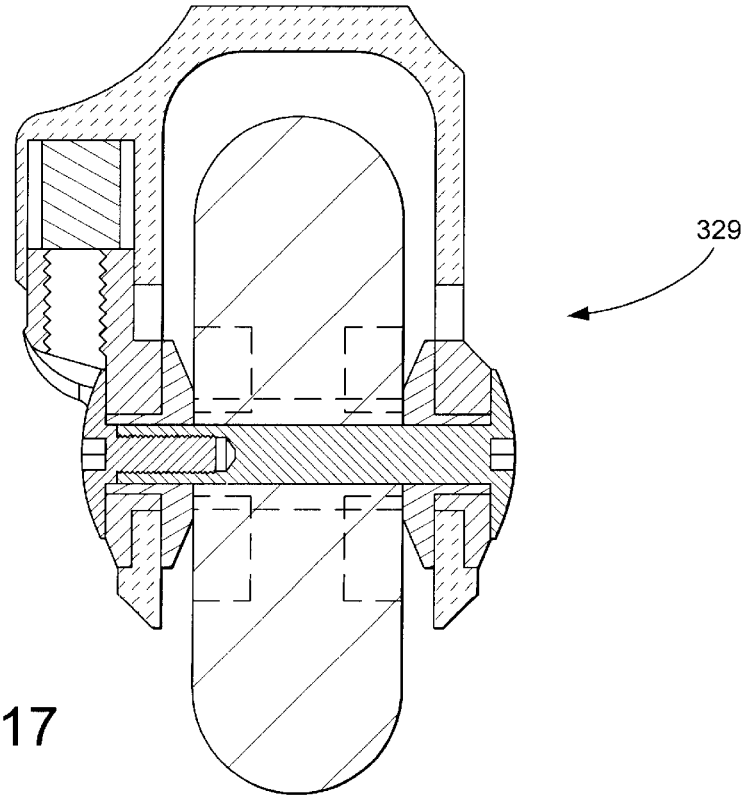

FIG. 17 shows another embodiment of the invention. This embodiment includes an axle supported at each end, but only one compressible medium. One receptacle and the top portion of one compressor are removed, as shown at 329, because there is only one compressible medium. Otherwise, this embodiment is similar to the embodiment shown in FIG. 9 and discussed above.

Figure 18:
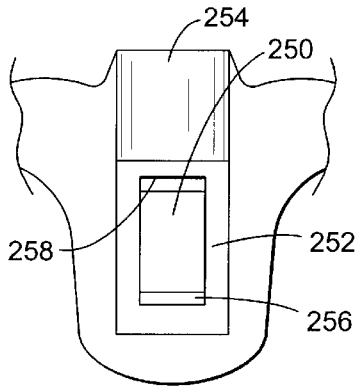
FIG. 18 shows an alternative aperture and components for use in some embodiments of the invention.
Figure 19:
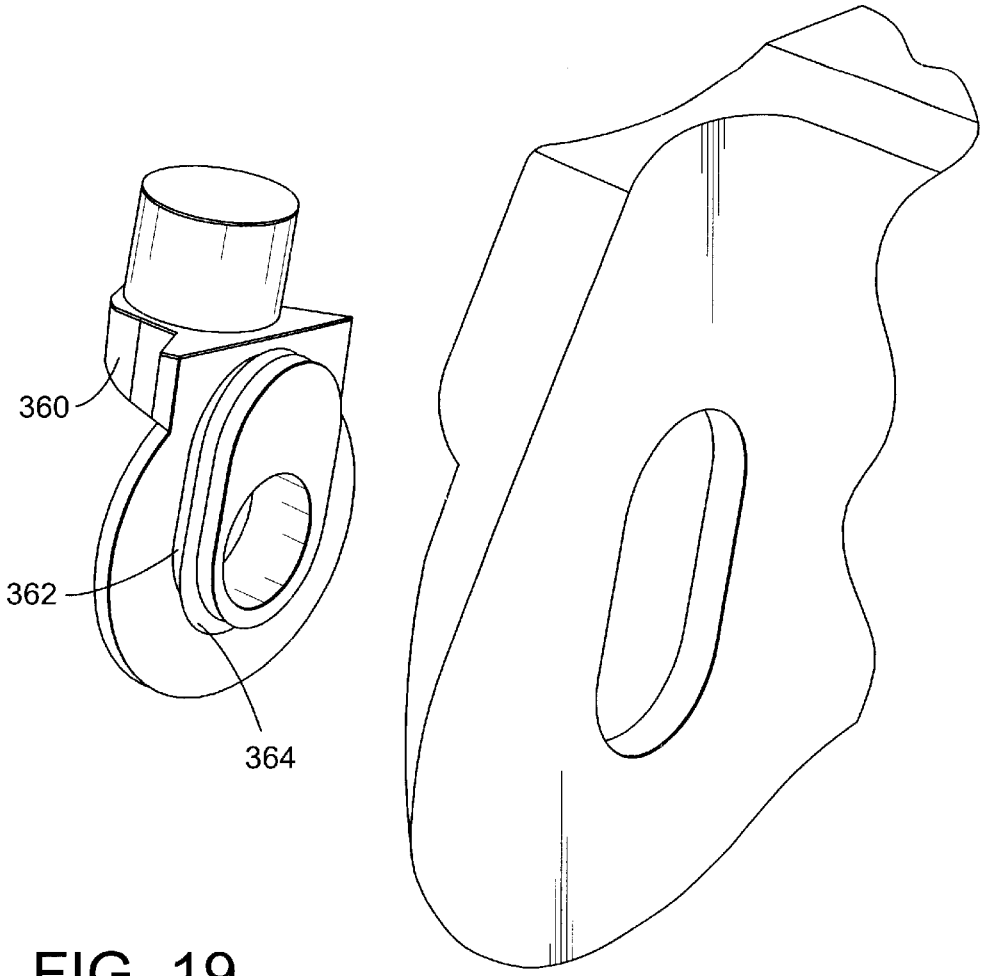
FIGS. 19 and 20 show alternative components for use in some embodiments of the invention.
Figure 20:
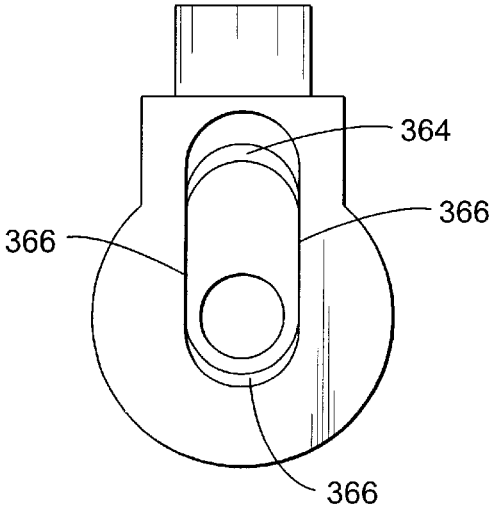

FIG. 18 is a simplified side view of a portion of an axle support. A rectangular aperture 250 is shown in a recess 252 in the axle support. A guide system and axle fit into aperture 250, as discussed above. A receptacle 254 to receive a compressible medium is positioned above aperture 250. Bumpers 256 and 258 are positioned in the aperture at the bottom and top of the aperture, respectively. The bumpers are made of a resilient, deformable material, such as rubber. The bumper may completely surround the aperture, or may simply be at the top and bottom of the aperture. The bumpers may be glued in place or held in place by friction. The bumpers act to cushion a guide system as the guide system moves up and down in the aperture between the top and bottom of the aperture. Often a guide system will move up and down quickly, depending on the forces applied to a skate's wheel, and the guide system may strike the top or bottom of the aperture and make a noise. This noise can be frequent and can distract a skater. The bumpers substantially eliminate the noise from a guide structure striking the top or bottom of an aperture. FIGS. 19 and 20 show another possible bumper. FIG. 19 shows a compressor 360 that includes an insert section 362, similar to the compressor described above in connection with FIGS. 9 and 10. A bumper 364 is positioned around insert section 362. Bumper 364 is made of a resilient, deformable material, such as rubber, and may take the form of an O-ring. Bumper 364 may be placed in a groove around the periphery of insert section 362 so that the bumper extends beyond the insert section only at the top and bottom, as shown in FIG. 20. The bumper extending along the sides of the insert section would be completely within the groove. In this manner, a hard surface of the insert section may contact the front and back sides of the aperture in the axle support, as shown at 366 in FIG. 20, thereby providing stability and noise reduction.

The above-described systems of axle supports, axles, guide systems, etc., may be thought of as support structure mounting wheels to a boot. The support structure holds an axle substantially horizontal relative to the sole of the boot. A skate may include various combinations of wheels with various support structures. For example, a skate may include four inline wheels with each wheel mounted to the skate so that the wheel may move toward the sole of the boot. Alternatively, a skate may have four wheels arranged in a line, with the first and last wheels in the line being able to move toward the boot, but with the middle two wheels mounted to the boot in a standard, non-shock absorbing manner. Various other combinations are possible, including shock absorbing middle wheels, three shock absorbing inline wheels, three shock absorbing inline wheels followed by two wheels mounted side-by-side, etc. In a split frame or Klop type skate, the rear two wheels may be moveable while the front two wheels are not, or vice versa.

Figure 22:
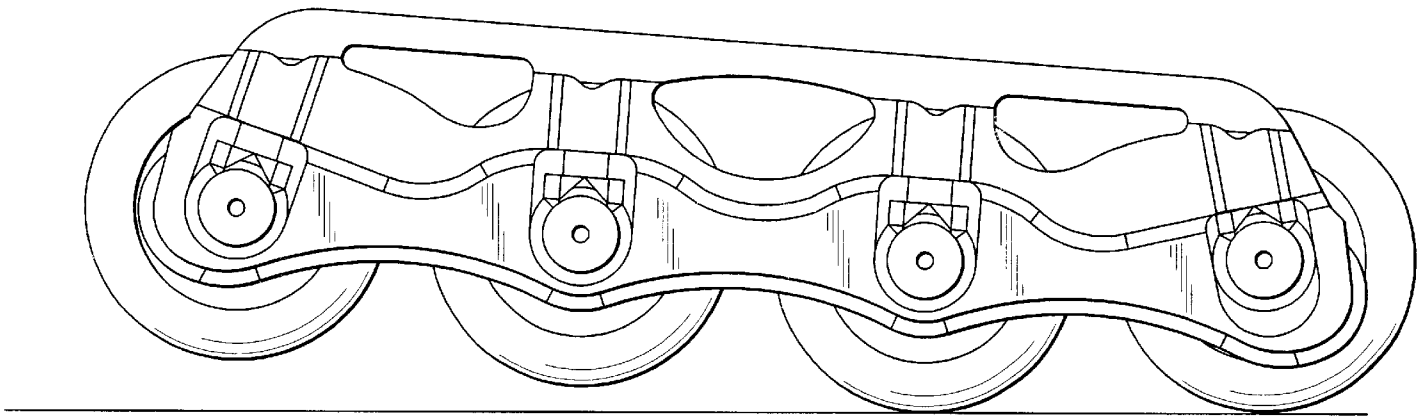
FIG. 22 illustrates how a skater may use various embodiments of the invention by leaning forward and back so that fewer than all of the wheels contact the ground.

Combining independently suspended wheels with non-moving wheels on a skate provides certain performance characteristics. For example, a skilled user of an inline skate with front and back wheels suspended for movement and the middle wheels fixed may increase the skate's maneuverability by leaning forward or back on the skate to unweight the front or back wheels. When the front or back wheels are unweighted, this shortens the wheelbase of the skate so that a user may turn more sharply than when all four wheels are weighted. This is illustrated in FIG. 22. This ability also may be accomplished with four independently suspended wheels, where the middle wheels are adjusted stiffer than the front and back wheels.

One advantage of the embodiments described above is that they may be used with standard wheels and bearings currently available in the marketplace. These wheels have varying diameters, such as 52 or 78 millimeters. Of course, the axle support in the embodiments described above must be constructed with sufficient clearance to accommodate wheels of varying diameter. The diameter of the wheel will determine how far below the support structure the wheel extends. A larger diameter wheel will extend below the support structure a greater distance than a wheel with a smaller diameter. That greater distance will affect how far a user may lean in the skate before the side of the skate scrapes along the ground. The amount that a user may lean in a skate may be thought of as the skate's clearance. Most of the embodiments described above are designed to have side-to-side widths that are as small as possible to provide as much clearance as possible. Using axle supports with blade-like portions, positioning receptacles for compressible media above the axle and outwardly from the blade-like portions, and minimizing the support structure extending below the axle allow for skates with increased clearance. Most of the embodiments described above may be adapted so that when they are in use on a substantially flat skating surface, the skate may be tilted to the side at least 40 degrees, typically 50–58 degrees, and up to 65 degrees from vertical without the wheel support structure or boot contacting the skating surface. These degrees of tilt are measured while leaning to the inside of the skate. A skate constructed according to one of the embodiments described above may have a support structure with a predetermined side-to-side width of 1 ½ to 2 inches, and typically 1 ¾ inches, at the axle, and the wheel typically may extend below the support structure a predetermined distance of ¾ of an inch to 1 inch.

The skates described above absorb vibrations and shocks while still providing high performance through lateral stability. The guide systems disclosed substantially prevent wheels from tilting. The various embodiments are easy to manufacture and assemble, especially those embodiments with integral axle supports and receptacles. The adjustable suspensions of the various embodiments allow skaters to individually customize the performance and maneuverability of their skates. Various embodiments also provide a low profile, high clearance for skate lean.

While the invention has been disclosed in its preferred forms, the specific embodiments thereof as disclosed and illustrated herein are not to be considered in a limiting sense as numerous variations are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicants'invention.

We claim:

1. A skate comprising:

a first wheel having two sides;

an axle associated with the first wheel and extending from one side of the first wheel to the other, the axle having two ends, one end extending from one side of first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle;

a second compressor associated with the axle and configured to compress the second compressible medium upon movement of the axle;

a first guide system associated with and separate from the axle, where at least a portion of the first guide system is configured to contact the axle, where at least a portion of the first guide system is configured to extend into the aperture of the first portion of the axle support, where the first guide system forms a pocket that sandwiches the first portion of the axle support, spans the first portion of the axle support, and has a sliding fit with the first portion of the axle support, and where at least a portion of the first guide system is configured to contact the first wheel to hold the wheel at a substantially fixed position away from the first portion of the axle support;

a second guide system associated with and separate from the axle, where at least a portion of the second guide system is configured to contact the axle, where at least a portion of the second guide system is configured to extend into the aperture of the second portion of the axle support, where the second guide system forms a pocket that sandwiches the second portion of the axle support, spans the second portion of the axle support, and has a sliding fit with the second portion of the axle support, and where at least a portion of the second guide system is configured to contact the first wheel to hold the wheel at a substantially fixed position away from the second portion of the axle support;

an attachment structure connected to the axle support and configured to attach the skate to a foot of a user; and at least one other wheel associated with the attachment structure.

2. The skate of claim 1 where the first portion of the axle support and the first receptacle are integral.

3. The skate of claim 1 where the axle support and the first and second receptacles are integral.

4. The skate of claim 1 where the position of the first guide system that is configured to contact the axle is integral with the first compressor.

5. The skate of claim 1 where the portion of the first guide system that is configured to extend into the first aperture of the first portion of the axle support is integral with the first compressor.

6. The skate of claim 1 where the portion of the first guide system that is configured to contact the first wheel is integral with the first compressor.

7. The skate of claim 1 where the portion of the first guide system that is configured to contact the axle is a spacer.

8. The skate of claim 1 where the portion of the first guide system that is configured to extend into the aperture of the first portion of the axle support includes a spacer.

9. The skate of claim 1 where the portion of the first guide system that is configured to contact the first wheel includes a spacer.

10. The skate of claim 1 where the portion of the first guide system that is configured to contact the axle is an axle bolt.

11. The skate of claim 1 where the portion of the first guide system that is configured to extend into the aperture of the first portion of the axle support is an axle bolt.

12. The skate of claim 1 where the first guide system includes a first spacer positioned on the axle between the first wheel and the first portion of the axle support, where the first spacer contacts the axle, where the first spacer includes a portion that extends along the axle and into the aperture of the first portion of the axle support, and where the first compressor contacts the first spacer.

13. The skate of claim 12 where the first compressor includes a portion that extends into the aperture of the first portion of the axle support.

14. The skate of claim 1 where each aperture has a length, and each aperture is configured to allow the axle to move along the length of the aperture.

15. The skate of claim 1 where each aperture has a width, and each guide system is configured to prevent movement of the axle along the width of the aperture.

16. The skate of claim 1 where the first guide system includes a first rigid surface configured to contact and slide along the first portion of the axle support, and the second guide system includes a second rigid surface configured to contact and slide along the second portion of the axle support, where the first and second surfaces contact the first and second portions of the axle support, respectively, to hinder tilting of the wheel.

17. The skate of claim 1 where the attachment structure is a boot.

18. The skate of claim 1 where the wheels are arranged in-line.

19. The skate of claim 1 where each of the first and second portions of the axle support has a predetermined, side-to-side thickness, and where each of the first and second pockets has a side-to-side dimension of no more than five one-thousandths of an inch greater than the side-to-side thickness of each of the first and second portions of the axle support, respectively.

20. The skate of claim 1 where the first pocket includes two substantially parallel surfaces.

21. The skate of claim 1 further comprising first and second spacers on the axle, the first spacer positioned between the first wheel and the first portion of the axle support, and the second spacer positioned between the first wheel and the second portion of the axle support, where the first and the second spacers are configured to contact the first wheel.

22. The skate of claim 21 where each spacer is separate from the first wheel so that the first wheel may turn independent of the spacers.

23. The skate of claim 21 where at least a portion of the first compressor and the first spacer together form the first guide system, and at least a portion of the second compressor and the second spacer together form the second guide system.

24. The skate of claim 21 where a least a portion of the first compressor extends into the aperture in the first portion of the axle support, and at least a portion of the first spacer extends into the same aperture.

25. The skate of claim 21 where the first compressor includes a hole into which at least a part of the first spacer extends; and where the second compressor includes a hole into which at least a portion of the second spacer extends.

26. The skate of claim 21 where the first spacer includes a head portion with a first surface that contacts the first wheel, where the first surface has a predetermined first side-to-side dimension, where the head portion includes a second surface that contacts the first portion of the axle support, and where the second surface has a predetermined second side-to-side dimension greater than the first side-to-side dimension.

27. The skate of claim 21 where the first and second spacers include bores through which the axle passes.

28. The skate of claim 1 where the first portion of the axle support includes an outer surface, and further comprising a recess in the outer surface, and where the first compressor includes a surface configured to fit in the recess.

29. The skate of claim 1 where each aperture is substantially rectangular.

30. The skate of claim 1 where each aperture is substantially oval.

31. The skate of claim 1 where the axle comprises an elongate shaft with a head at and a threaded socket at the other end, and a bolt with a head and a threaded on configured to thread into the socket.

32. The skate of claim 1 where the first compressible medium is an elastomer.

33. The skate of claim 1 where the first compressible medium is urethane.

34. The skate of claim 1 where the first compressible medium is a spring.

35. The skate of claim 1 where the first receptacle and the first compressible medium are configured to allow the first compressible medium to bulge when compressed.

36. The skate of claim 35 where the first receptacle is a socket, and where the socket is configured to limit the bulging of the first compressible medium.

37. The skate of claim 1 where the compressibility of the first compressible medium is adjustable.

38. The skate of claim 37 where the first compressible medium is adjustable by pre-compressing the medium so that a greater force is required to further compress the medium than would be required if the medium was not pre-compressed.

39. The skate of claim 37 where the first compressibility of the compressible medium is adjustable by a moveable member extending in a channel through the first compressor so that the member may pre-compress the compressible medium.

40. The skate of claim 39 where the moveable member and channel are threaded.

41. The skate of claim 1 where the compressibility of each of the first and second compressible media is adjustable.

42. The skate of claim 1 further comprising a first bumper in the bottom of the aperture of the first portion of the axle support.

43. The skate of claim 1 having at least four wheels, and an axle, axle support, compressible medium, and first and second guide systems for each of the wheels.

44. The skate of claim 43 where the compressibility of each of the compressible media associated with each wheel is adjustable.

45. The skate of claim 44 where the compressibility of the compressible media associated with one wheel is adjusted to be stiffer than the compressibility of the compressible media associated with another wheel.

46. The skate of claim 1, wherein the portion of the first guide system that is configured to contact the axle is separately positionable relative to the first compressor.

47. The skate of claim 46, wherein the portion of the first guide system that is configured to contact the axle is in contact with the first compressor.

48. The skate of claim 1, wherein the first and the second portions of the axle support each include inner surfaces that generally face the first wheel and outer surfaces that generally face away from the first wheel, and further wherein the first and the second pockets are adapted to engage and slide along the inner and the outer surfaces of the first and the second portions of the axle support.

49. The skate of claim 1, wherein the first compressor forms at least a portion of the first pocket.

50. The skate of claim 1, wherein the first guide system includes a first spacer that extends generally between the first portion of the axle support and the first wheel and which forms a portion of the first pocket.

51. The skate of claim 16, wherein the first and the second portions of the axle support each include inner surfaces that generally face the first wheel and outer surfaces that generally face away from the first wheel, and further wherein the first and the second rigid surfaces are respectively positioned to contact and slide along the outer surfaces of the first and the second portions of the axle support.

52. The skate of claim 51, wherein the first and the second guide systems further include third and fourth rigid surfaces that are respectively configured to contact and slide along the inner surfaces of the first and the second portions of the axle support.

53. The skate of claim 52, wherein the third and the fourth rigid surfaces respectively form at least a portion of a first and a second spacer, and further wherein the first and the second spacers respectively extend generally between the first and the second portions of the axle support and the first wheel.

54. The skate of claim 53, wherein the first and the second spacers respectively further extend at least partially into the apertures in the first and the second portions of the axle support.

55. The skate of claim 16, wherein the first and the second portions of the axle support each include inner surfaces that generally face the first wheel and outer surfaces that generally face away from the first wheel, and further wherein the first and the second rigid surfaces are respectively positioned to contact and slide along the inner surfaces of the first and the second portions of the axle support.

56. The skate of claim 55, wherein the first and the second guide systems further include third and fourth rigid surfaces that are respectively configured to contact and slide along the outer surfaces of the first and the second portions of the axle support, and further wherein the third and the fourth rigid surfaces respectively form at least a portion of a first and a second spacer, and further wherein the first and the second spacers respectively extend generally between the first and the second portions of the axle support and the first wheel.

57. The skate of claim 56, wherein the first and the second spacers respectively further extend at least partially into the apertures in the first and the second portions of the axle support.

58. A skate comprising:

a first wheel having two sides;

an axle associated with the first wheel and extending from one side of the first wheel to the other, the axle having two ends, one end extending from one side of the first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle, the first compressor including a portion that extends into the aperture of the first portion of the axle support;

a second compressor associated with the axle and configured to compress the second compressible medium upon movement of the axle, the second compressor including a portion that extends into the aperture of the second portion of the axle support;

a first spacer associated with the axle, separately positionable relative to the first compressor, and positioned between the first wheel and the first portion of the axle support, where the first spacer contacts the first wheel and includes a portion that extends along the axle and into the aperture;

a second spacer associated with the axle, separately positionable relative to the second compressor, and positioned between the first wheel and the second portion of the axle support, where the second spacer contacts the first wheel;

an attachment structure connected to the axle support and configured to attach the skate to a foot of a user; and at least one other wheel associated with the attachment structure.

59. The skate of claim 58, wherein the portion of the first spacer extends through the aperture.

60. The skate of claim 58, wherein the first spacer contacts the first wheel.

61. The skate of claim 58, wherein the first wheel is adapted to be rotated independent of the first and the second spacers.

62. A skate comprising;

a first wheel having two sides;

an axle associated with the first wheel and extending from one side of the first wheel to the other, the axle having two ends, one end extending from one side of the first wheel and, the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle, the first compressor including a portion that extends into the aperture of the first portion of the axle support;

a second compressor associated with the axle and configured to compress the second compressible medium upon movement of the axle, the second compressor including a portion that extends into the aperture of the second portion of the axle support;

a first spacer associated with the axle and positioned between the first wheel and the first portion of the axle support, where the first spacer contacts the first wheel, where the first spacer includes a hole through which the axle extends, where at least a portion of the first spacer extends into the aperture, and where the first compressor includes a hole through which a portion of the first spacer extends;

a second spacer associated with the axle and positioned between the first wheel and the second portion of the axle support, where the second spacer contacts the first wheel;

an attachment structure connected to the axle support and configured to attach the skate to a foot of a user; and at least one other wheel associated with the attachment structure.

63. A skate comprising:

a first wheel having two sides;

an axle associated with the first wheel and extending from one side of the first wheel to the other, the axle having two ends, one end extending from one side of the first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle;

a second compressor associated with the axle and configured to compress the second compressible medium upon movement of the axle;

a first spacer associated with the axle, where the first spacer contacts the first compressor, extends through the aperture in the first portion of the axle support, and contacts the first wheel;

a second spacer associated with the axle, where the second spacer contacts the first compressor, extends through the aperture in the second portion of the axle support, and contacts the first wheel, where the first and second spacers include sleeves that fit over the axle and that pass through holes in the first and second compressor, respectively;

an attachment structure connected to the axle support and configured to attach the skate to a foot of a user; and at least one other wheel associated with the attachment structure.

64. A skate comprising:

a first wheel having two sides;

an axle associated with the first wheel and extending from one side of the first wheel to the other, the axle having two ends, one end extending from one side of the first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle;

a second compressor associated with the axle and configured to compress the second compressible medium upon movement of the axle;

a first spacer associated with the axle, separately formed from the first compressor, and positioned between the first wheel and the first portion of the axle support, where the first spacer includes a head that contacts the first wheel and further includes a neck that extends from the head and through the aperture in the first portion of the axle support and contacts the first compressor;

a second spacer associated with the axle, separately formed from the second compressor, and positioned between the first wheel and the second portion of the axle support, where the second spacer includes a bead that contacts the first wheel and further includes a neck that extends from the head and through the aperture in the second portion of the axle support and contacts the second compressor;

an attachment structure connected to the axle support and configured to attach the skate to a foot of a user; and at least one other wheel associated with the attachment structure.

65. The skate of claim 64, wherein the first wheel is adapted to be rotated independent of the first and the second spacers.

66. The skate of claim 64, wherein the heads are respectively further adapted to contact and slide against the first and the second portions of the axle support.

67. A skate comprising:

a first wheel having two sides;

an axle associated with the first wheel and extending from one side of the first wheel to the other, the axle having two ends, one end extending from one side of the first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first guide system associated with and separate from the axle, where at least a portion of the first guide system is configured to contact the axle, where at least a portion of the first guide system is configured to extend into the aperture of the first portion of the axle support, and where at least a portion of the first guide system includes a first spacer that is positioned on the axle, extends between the first wheel and the second portion of the axle support and is configured to contact the first wheel to hold the wheel at a substantially fixed position away from the first portion of the axle support;

a second guide system associated with and separate from the axle, where at least a portion of the second guide system is configured to contact the axle, where at least a portion of the second guide system is configured to extend into the aperture of the second portion of the axle support, and where the second guide system includes a second spacer that is positioned on the axle, extends between the first wheel and the second portion of the axle support and is configured to contact the first wheel to hold the wheel at a substantially fixed position away from the second portion of the axle support;

a first compressor associated with the axle and configured to compress the first compressible medium upon movement of the axle, wherein the first compressor includes a hole into which at least a part of the first spacer extends;

a second compressor associated with the axle and configured to compress the second compressible medium upon movement of the axle, wherein the second compressor includes a hole into which at least a part of the second spacer extends;

an attachment structure connected to the axle support and configured to attach the skate to a foot of a user; and at least one other wheel associated with the attachment structure.

68. A skate comprising:

a first wheel having two sides;

an axle associated with the first wheel and extending from one side of the first wheel to the other, the axle having two ends, one end extending from one side of the first wheel and the other end extending from the other side of the first wheel;

an axle support including a first portion extending along one side of the first wheel, and a second portion extending along the other side of the first wheel, each portion including an aperture configured to support an end of the axle, and where each aperture is configured to allow movement of the axle;

a first receptacle proximate the first portion of the axle support and positioned outwardly from the first portion of the axle support relative to the first wheel;

a second receptacle proximate the second portion of the axle support and positioned outwardly from the second portion of the axle support relative to the first wheel;

a first compressible medium associated with the first receptacle;

a second compressible medium associated with the second receptacle;

a first compressor associated with the axle and configured to compress the first compressible medium upon movement of the axle;

a second compressor associated with the axle and configured to compress the second compressible medium upon movement of the axle;

a first guide system associated with and separate from the axle, where at least a portion of the first guide system is configured to contact the axle, where at least a portion of the first guide system is configured to extend into the aperture of the first portion of the axle support, where the first guide system forms a pocket that sandwiches the first portion of the axle support, has a sliding fit with the first portion of the axle support, and includes at least a portion of the first compressor, and where at least a portion of the first guide system is configured to contact the first wheel to hold the wheel at a substantially fixed position away from the first portion of the axle support;

a second guide system associated with and separate from the axle, where at least a portion of the second guide system is configured to contact the axle, where at least a portion of the second guide system is configured to extend into the aperture of the second portion of the axle support, where the second guide system forms a pocket that sandwiches the second portion of the axle support, has a sliding fit with the second portion of the axle support, and includes at least a portion of the second compressor, and where at least a portion of the second guide system is configured to contact the first wheel to hold the wheel at a substantially fixed position away from the second portion of the axle support;

an attachment structure connected to the axle support and configured to attach the skate to a foot of a user; and at least one other wheel associated with the attachment structure.

* * * * *

UNITED STATES PATENT AND TRADEMARK OFFICE

CERTIFICATE OF CORRECTION

PATENT NO. : 6,416,063 B1 
DATED : July 9, 2002
INVENTOR(S) : Scott H. Stillinger and Daniel M. Humes It is certified that error appears in the above-identified patent and that said Letters Patent is hereby corrected as shown below:

Column 14,
Line 34, after "from one side of" please insert -- the --.

Column 15,
Line 28, after "where the" please delete "position" and insert -- portion -- therefor.

Column 16,
Line 64, after "with a head at" please insert -- one end --.
Line 65, after "and a threaded" please delete "on" and insert -- extension -- therefor.

Column 19,
Line 28, after "wheel and" please delete ",".

Column 21,
Line 25, after "spacer includes a" please delete "bead" and insert -- head -- therefor.

Signed and Sealed this

Twenty-sixth Day of November, 2002

*Attest:*

*Attesting Officer*

JAMES E. ROGAN
*Director of the United States Patent and Trademark Office*